United States Patent [19]

Gress et al.

[11] 4,217,915

[45] Aug. 19, 1980

[54] HEATED HAIR BRUSH

[76] Inventors: Bernd Gress, Urbanstrasse 141; Rainer Deüringer, Uhlandstrasse 40, both of D-7300 Esslingen, Fed. Rep. of Germany

[21] Appl. No.: 934,476

[22] Filed: Aug. 17, 1978

Related U.S. Application Data

[63] Continuation-in-part of Ser. No. 694,662, Jun. 10, 1976, abandoned.

[30] Foreign Application Priority Data

Jun. 14, 1975 [DE] Fed. Rep. of Germany ..... 2526637

[51] Int. Cl.[2] ..... A45D 20/00

[52] U.S. Cl. ..... 132/9; 132/85

[58] Field of Search ..... 132/9, 37 R, 33 R, 11 R, 132/85; 15/186, 187, 202–203, 176, 1.5 A, 192, 117, 400; 128/62

[56] References Cited

U.S. PATENT DOCUMENTS

| | | | |
|---|---|---|---|
| 1,033,122 | 7/1912 | Schwartz | 132/37 R |
| 1,597,855 | 8/1926 | Zahorsky | 15/400 |
| 2,482,928 | 9/1949 | Neff et al. | 128/62 R |
| 3,563,250 | 2/1971 | DeFalandre | 132/11 R |
| 3,750,680 | 8/1973 | Miller | 132/11 R |
| 3,927,684 | 12/1975 | Lam | 132/37 R |
| 4,114,222 | 9/1978 | Sergdiuk | 132/151 |

FOREIGN PATENT DOCUMENTS

| | | | |
|---|---|---|---|
| 82305 | 1/1895 | Fed. Rep. of Germany | 132/9 |
| 83510 | 2/1895 | Fed. Rep. of Germany | 132/9 |

*Primary Examiner*—G. E. McNeill

*Attorney, Agent, or Firm*—Frishauf, Holtz, Goodman & Woodward

[57] ABSTRACT

To facilitate curling and waving of hair during brushing, the hair brush has a cylindrical body which has an outer surface which is of a good heat conducting material, in which bristles, in the form of plastic stubs, are inserted. An electrical heating element is in thermally conductive relationship with the heat conductive surface so that hair can be dried, straightened, or curled by contact with the heated body while being brushed, and without danger of contact with the skin due to the spacing effects of the bristles. The bristles are preferably molded integrally with a rail or strip inserted into grooves in the heated body.

10 Claims, 6 Drawing Figures

HEATED HAIR BRUSH

This is a continuation-in-part of my application Ser. No. 694,662, filed June 10, 1976, abandoned.

The present invention relates to a heated hair brush with a handle and with a body to which bristles are attached.

BACKGROUND AND PRIOR ART

In many hair setting operations, the hair is frequently no longer first set and then dried, but rather is subjected to warm or hot air treatment while being simultaneously curled or waved. The various steps necessary to set curls or waves are time-consuming and bothersome if they have to be carried out separately from the drying step.

It is customary to use one hand for hair brushing and the other to hold a warm or hot-air dryer. Hair brushes have also been proposed which, in order to facilitate setting of the hair, are combined with a hair dryer. Customarily, such a hair brush-dryer is formed as an attachment which can be used with a hot-air drying arrangement; the attachment has nozzles to emit the hot air. Such combined attachments and hair brushes have the disadvantage that the hot or warm air which is emitted from the nozzle tends to blow away the hair being brushed thus interfering with the shape or form intended to be applied to the hair as the hair is being set.

THE INVENTION

It is an object to facilitate hair grooming and, more particularly, to speed the process of setting hair while effecting drying the same.

Briefly, the hair brush comprises a hollow cylindrical brush body which has an outer surface of good heat conductive material; heating elements, for example electrical resistance wires or coils, are located in the body in thermally conductive relation to the outer cover.

The cover may be made of metal or other similar good heat conductive material. Preferably, it is formed with grooves in which the bristles, in form of spaced poorly heat conductive stubs teeth or tines, are inserted, e.g. by being molded on a strip inserted in the grooves. The bristles may be plastic or of nautral material, and of sufficient stiffness to reliably space the heated surface from the skin of the user. The heating element is preferably an electrical resistance heating coil retained in insulated relationship with respect to the outside cover by a suitable, e.g. ceramic holder, inserted into the hollow brush body. The bristles are located throughout the circumference of the cylindrical body.

The hair brush has the specific advantage that burning of the skin of the head is avoided even if the body of the brush is comparatively hot. The skin of the head of the user is not exposed to a blast of hot air, which can be very disagreeable. Due to the poor heat conductivity of the bristles, particularly in relationship to the outer covering of the brush, the bristles will not heat substantially and thus the skin of the head with which the bristles come in contact is not exposed to excessive heat. The heated body of the brush only touches the hair.

The invention will be described by way of example with reference to the accompanying drawings, wherein.

Figure 1:
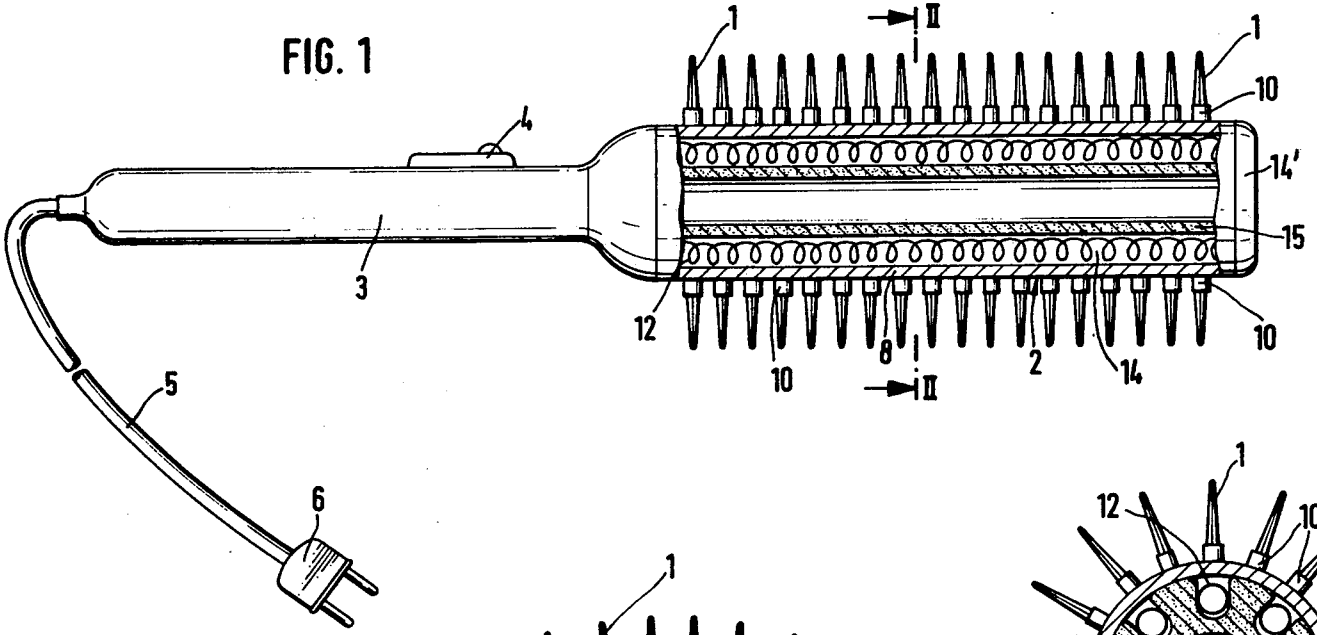
FIG. 1 is a part-section, longitudinal view of the hair brush in accordance with the present invention.

The brush essentially has a brush body 2 to which bristles 1 are attached. A brush body is attached to a handle 3 which can also carry an electrical switch 4. An electrical cable 5 with a plug 6 extends from handle 3. Handle 3 is made of a material which is a poor conductor of heat, for example plastic; it is hollow to permit the electrical cable 5 to pass therethrough and to provide space for the switch 4.

Figure 2:
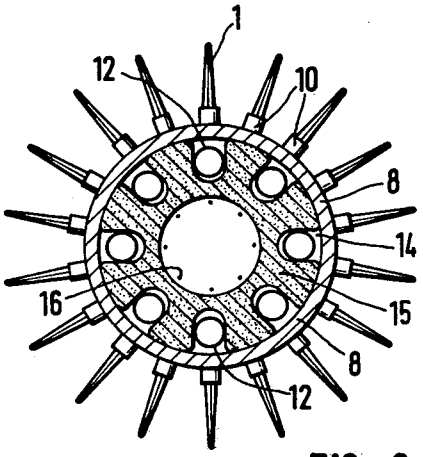
FIG. 2 is a cross-section view of the brush taken along line II—II of FIG. 1.

The brush body 2 has a hollow outer cover or jacket 8, made of a material which is a good conductor of heat, for example metal. In the embodiment of FIGS. 1 and 2, the outer cover 8 is formed as a circular hollow cylinder. Uniformly distributed over the circumference, in longitudinal as well as circumferential direction, are stubs or projections 10; in their simplest form, they are made of the same material as the cover 8 and are formed therewith as one single integral casting or molding, or are otherwise attached to the body 8. The stubs 10 are formed with radial bores which receive at least one bristle 1. The bristles 1 are made of a material which is a poor heat conductor, for example a plastic, or are natural bristles. Thus, the body 2 can be relatively highly heated in order to effect intensive drying of hair in immediate contact therewith, or in close proximity thereto; the bristles 1 which will conduct heat only poorly and thus will heat only little, can safely come in contact with the skin of the head. Thus, the head and the skin are protected from high temperatures, which are highly disagreeable.

The body 2 includes electrical heating elements; they are spiral heating coils 12 which consist of well-known helically wound electrical resistance wire. The heating coils 12 are located in grooves 14 of a ceramic carrier 15 (see FIG. 2). The grooves extend parallel to the longitudinal axis of the brush and they are open towards the outside, that is, towards the cover 8. Their edges may be slightly turned inwardly to prevent escape of the electrical heating wire towards the outside, and sagging of the wire as it gets hot. Thus, contact with the metallic outer cover is reliably prevented. The ceramic carrier 15 is, preferably, approximately circular in cross section and, for assembly, is merely pushed axially into the cover 8; the cover 8 is then closed off at the facing ends with an end cover 14. The heating spirals 12 are separate or grouped together and suitably connected electrically, for example in parallel; various electrical connections may be made, for example by selectively connecting some of the spirals serially with respect to the others, or in parallel, to provide various heat settings. The return conductors of the heating spiral 12 are seen in FIG. 2 schematically at 16.

Figure 3:
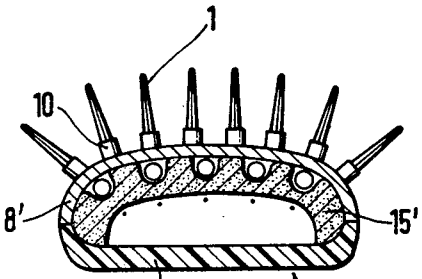
FIG. 3 is a cross-sectional view of a hair brush illustrating another embodiment, the cross section being taken as in FIG. 2.

The brush in accordance with FIG. 3 is essentially similar to that of FIGS. 1 and 2, except that the shape of the brush body is flattened and the brush body is supplied with bristles only on one side. The outer jacket or cover 8' and the ceramic carrier 15' are suitably shaped to fit into the brush body. The brush body is closed off at the bottom with a flat bottom portion 18. The bottom 18 is made of a material which is a poor conductor of heat; it may be unitary with the handle 3', for example by forming one single injection molding element.

The round brush of FIGS. 1 and 2 permits effective winding of hair thereover, with application of substantial tension on the hair as it is being wound. This type of brush is particularly adapted to form curls.

The heating elements for the brushes may take various forms, and the ceramic carrier therefor will be shaped to fit; for example, the carrier 15 may be a porcelain cylinder with grooves extending circumferentially on which electrical resistance wire is wound. Porcelain cylinders, similar to the ceramic carrier 15 over which electrical resistance wire is uniformly distributed, may also be used to heat the cover 8 of the brush body 2.

Two elements similar to FIG. 3 may be joined back-to-back with an electrical connection between one element and the handle of the other. Thus, a universal structure suitable both for curls as well as for waves would result. While the handle can be duplicated, only one of the elements needs to have the connecting wire and be formed with a receptacle, the other element having a plug fitting into the receptacle, for example located on the projecting stub from the portion forming the brush body 2 itself.

Figure 4:
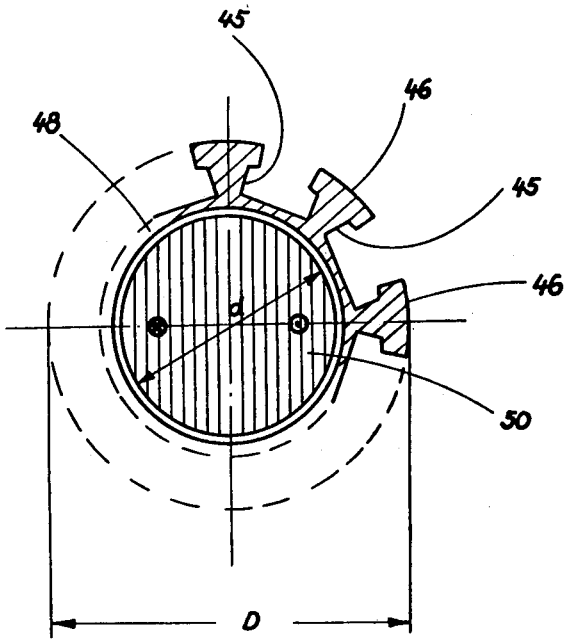
FIG. 4 is a schematic cross-sectinal view through the body illustrating another embodiment of the invention.
Figure 5:
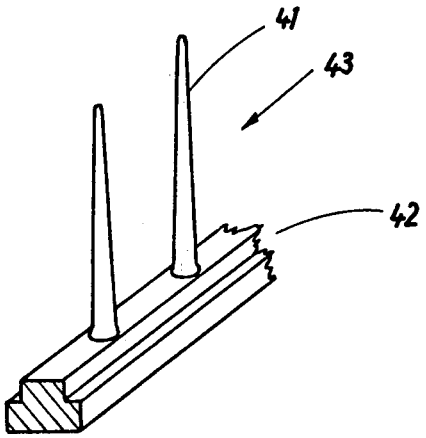
FIG. 5 is a perspective highly schematic view of a bristle rail for assembly with the body of FIG. 4.
Figure 6:
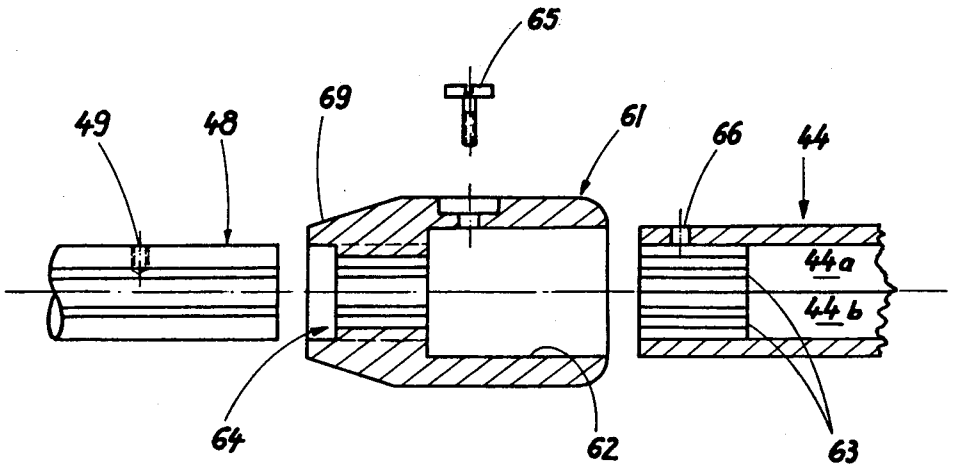
FIG. 6 is a fragmentary schematic exploded view of the attachment of the body to the handle using an intermediate bushing.

FIGS. 4 to 6 illustrate a particularly simple way of making and assembling the heated brush, which results in an overall structure which is light, easy to handle, reliable and safe in use.

The bristles or stubs 41 in the form of individual, comb-like, spaced teeth or tines (FIG. 5), are formed as plastic elements, for example of hard rubber which is heat-resistant, or the like, and molded integrally with a longitudinal rail 42 which has generally T-shaped cross section, the cross bar of the T being at the side opposite that where the bristles or stubs or teeth 41 are molded on. The length of the teeth 41, in a typical example, is about 1 cm; the width of the rail 42 at the narrow portion is about 1 mm, amd at the wider, cross T portion about 2 mm. The height of the rail 42 itself is about 2 mm. The rail assembly, generally shown at 43 (FIG. 5) is slid longitudinally into matching grooves 45 (FIG. 4) formed on the body 48. The body 48 is of good heat conductive material and retains therein a heating element 50, for example a pair of resistance wires molded into a ceramic element, or a similar elongated plug-like heater. This heater need not provide substantial power; a rating of between 10 to 20, preferably in the order of about 15 W is suitable. The inner diameter d of the body 48, in a typical example, is about 1 cm, the outer diameter, including the projection T portion 46 of te body, between which the grooves 45 are defined, resulting in an overall body diameter D of about 2 cm, or just slightly less. Thus, the bristles or stub or teeth 41 on the bristle assembly 43 can be easily assembled with the body 48, providing good, reliable connection of the heat insulatings bristles or stubs or teeth while spacing the skin of the user from the surfaces of the T-projections 46 formed on the body 48.

This arrangment permits simple and rapid assembly to a handle 44 (FIG. 6). The handle 44 is a hollow plastic tube, for example formed of two longitudinally slit cylindrical portions 44*a* and 44*b* which, at the end facing the heated body 48, is formed with internally projecting T-ribs 63 having the shape of the T-ribs 42. A bushing 61 has a first internally smooth portion 62 and a second internally ribbed portion 64. The internal ribs of portion 64 have the T-shape fitting into the grooves 45 of the body 48. For assembly, the body 48 is slid into the bushing 61, with the internally projecting ribs of portion 64 engaging into the grooves 45 of body 48. Body 48 is slid into the bushing 61 all the way to the far end thereof. The handle 44 is then slid over the body 48, with the T-projections or internal ribs 63 engaging into the grooves 45 of body 48. The asesmbly is now securely locked together against rotation, and frictionally engaged. To maintain the entire assembly together, a set screw 65 is passed through the body 61, through a hole 66 in the handle 44 and tapped into a suitable hole 49 formed in body 48. A projecting ridge 69 which fits snugly over the circumference of body 48 holds the end portions of rails 42 with the bristles or stubs or teeth 41 thereon in position. For assembly, the rails are first assembled to the body 48, the subassembly is then assembled with bushing 61 and handle 44, and finally the holding screw 65, which may be a self-tapping screw, introduced through opening 66 into the hole 49 which, preferably, is located to pass through a T-projection on the body 48. The body 48 being hollow, and the handle being hollow, the heater assembly and wires therefor can readily pass from the handle into the body 48 to be received therein and held therein, for example by frictional engagement or by the stiffness of the connecting wires (not shown).

The arrangement thus permits rapid assembly of a small tubular element, small enough to form a curling brush, which has the additional capability of being heated, while the brush bristles or stubs reliably space the heated surface from the skin of the user to prevent accidental contact, hence burning, or other injury. Spacing the bristles circumferentially around the cylindrical body 2, or 48, respectively, prevents accidental contact regardless of the position of the handle, and hence of the brush with respect to the skin of the user. In a preferred form, the electrical cable 5 is attached to the handle 3 by means of a movable swivel connection to improve versatility of use.

The bristles or teeth, though flexible or bendable, are relatively stiff, so that they cannot be bent over completely at right angles, in order to space the heated outer cover portion of the body 2 (FIGS. 1, 2), 48 (FIGS. 4–6) respectively from the user. In a preferred form, these bristles or teeth are made of Polyamide. They should not, under normal brushing use pressure, deflect to such an extent that the longitudinal distance from the surface of the heated body to the deflected height of the bristles is less than half their length. Since wide variations in materials, stiffness and number of bristles is possible, the term "stiffly" projecting and yieldingly deflectable will be used to describe such bristles or teeth which, while providing resistance towards a 90° bend from their roots, still permit yielding deflection of the end portions as desired for a good brush.

Various changes and modifications may be made, and features described in connection with any one of the embodiments may be used with any of the others, within the scope of the inventive concept.

We claim:

1. Electrically heated curling-type hair brush having a bristle carrier body (2, 48) formed as a hollow structure having a outer, exposed surface (8) made of good heat conductive material, electrical resistance heating elements (12, 50) located within the hollow structure and positioned in heat transfer relation to said exposed heat conductive surface, and bristles (1, 41) secured to the carrier body, wherein the bristles (1, 41) are characterized in that they comprise poorly heat conductive or heat insulating, stiffly projecting and yieldingly deflectable material and that they are located the outer, good heat conductive surface (8) uniformly distributed about the length and circumference of the body (2, 48) and spaced from each other to permit contact and close proximity of hair with the heated body and the outer surface thereof, separate hair strands, and further to prevent contact of any portion of the heated body with the skin of the user.

2. Hair brush according to claim 1, wherein the hollow structure is formed with projecting stubs (10) of good heat conductive material, the bristles (1) being secured to said stubs.

3. Hair brush according to claim 2, wherein the stubs (10) and the hollow structure forming the outer cover (8) are a unitary, single casting.

4. Hair brush according to claim 1, wherein the outer portion (8) of the good heat conductive carrier body (2, 48) is formed with apertures having a reentrant portion; and the roots (42) of the bristles (41) are formed with a holding portion interengaging with and interlocking with the reentrant apertures on the body.

5. Hair brush according to claim 1, further comprising a ceramic carrier form (15) supporting resistance wires (12) within the hollow body.

6. Hair brush according to claim 1, wherein the outer cover (8) is of essentially cylindrical cross section.

7. Hair brush according to claim 1, wherein (FIG. 4) the body is an elongated, essentially cylindrical element formed with inverted T-grooves (45) formed on the circumference thereof;

a rail-like support (42) of generally T-shaped cross section, to which the bristles (41) are secured and molded integrally therewith, the T-rail being inserted into the inverted T-grooves.

8. Hair brush according to claim 7, wherein the grooves extend essentially axially of the body.

9. Hair brush according to claim 7, further including an essentailly cylindrical, hollow handle having an end portion thereof formed with internally extending T-ribs (63) shaped to fit into the inverted T-grooves (45) formed on the hollow body (48);

and a connecting bushing (61) having means (62, 64) receiving both an end portion of the cylindrical body (48) and a matching end portion of the handle (44) with the internal ribs (63) on the handle in engagement with the inverted T-grooves (45) of said body.

10. Hair brush according to claim 9, wherein said connecting bushing includes an internally ribbed portion (64) formed with internally projecting T-ribs fitting into the inverted T-grooves (45) of the hollow body (48) to thereby receive and lock together said hollow body (48) and said handle (44) while being itself restrained against rotation with respect to said hollow body (48) by engagement of the internally projecting T-ribs with the inverted T-grooves on the hollow body (48).

* * * * *

UNITED STATES PATENT AND TRADEMARK OFFICE

CERTIFICATE OF CORRECTION

PATENT NO. : 4,217,915

DATED : August 19, 1980

INVENTOR(S) : HEATED HAIR BRUSH

It is certified that error appears in the above-identified patent and that said Letters Patent are hereby corrected as shown below:

Claim 1, line67 (column 4) change "a" to -- an -- after "surface" insert -- portion -- line 4, (column 5) after "surface" insert -- portion --

9, (column 5) after "located" insert -- adjacent --

10, (column 5) after "surface" insert -- portion --

14, (column 5) after "outer" insert -- good heat conductive --

14, (column 5) after "surface" insert -- portion --

14, (column 5) before "separate" insert -- to --

Signed and Sealed this

*Seventeenth* Day of *February 1981*

[SEAL]

*Attest:*

RENE D. TEGTMEYER

*Attesting Officer*

*Acting Commissioner of Patents and Trademarks*